US009228718B2

(12) United States Patent
Ooya et al.

(10) Patent No.: US 9,228,718 B2
(45) Date of Patent: Jan. 5, 2016

(54) LED LIGHT BULB

(71) Applicants: KABUSHIKI KAISHA TOSHIBA, Tokyo (JP); TOSHIBA MATERIALS CO., LTD., Yokohama-shi, Kanagawa (JP)

(72) Inventors: Yasumasa Ooya, Chigasaki (JP); Masahiko Yamakawa, Yokohama (JP); Yasuhiro Shirakawa, Yokohama (JP); Katsutoshi Nakagawa, Yokohama (JP)

(73) Assignees: KABUSHIKI KAISHA TOSHIBA, Tokyo (JP); TOSHIBA MATERIALS CO., LTD., Yokohama-Shi (JP)

( * ) Notice: Subject to any disclaimer, the term of this patent is extended or adjusted under 35 U.S.C. 154(b) by 253 days.

(21) Appl. No.: 13/797,192

(22) Filed: Mar. 12, 2013

(65) Prior Publication Data

US 2013/0188333 A1 Jul. 25, 2013

Related U.S. Application Data

(63) Continuation of application No. PCT/JP2011/005073, filed on Sep. 9, 2011.

(30) Foreign Application Priority Data

Sep. 17, 2010 (JP) ..... 2010-209142

(51) Int. Cl.
*F21V 9/16* (2006.01)
*F21K 99/00* (2010.01)
(Continued)

(52) U.S. Cl.
CPC . *F21V 9/16* (2013.01); *F21K 9/135* (2013.01); *F21K 9/56* (2013.01); *F21V 3/00* (2013.01); *F21V 3/02* (2013.01); *F21V 3/0481* (2013.01); *F21Y 2101/02* (2013.01)

(58) Field of Classification Search
CPC ..... F21V 3/00; F21V 3/02; F21V 3/0481; F21V 9/16; F21K 9/56; F21K 9/135; F21Y 2101/02
See application file for complete search history.

(56) References Cited

U.S. PATENT DOCUMENTS 5,032,960 A * 7/1991 Katoh ..... 362/240
8,506,103 B2 8/2013 Iimura et al.
(Continued)

FOREIGN PATENT DOCUMENTS

JP 2005-005546 A 1/2005
JP 2009-040918 A 2/2009
(Continued)

OTHER PUBLICATIONS

Y. Ooya, U.S. PTO Office Action, U.S. Appl. No. 13/774,574, dated Sep. 23, 2013, 11 pages.
(Continued)

*Primary Examiner* — Stephen F Husar
(74) *Attorney, Agent, or Firm* — Foley & Lardner LLP

(57) ABSTRACT

In one embodiment, an LED light bulb includes an LED module, a base part on which the LED module is disposed, and a globe attached to the base part. The LED module includes an ultraviolet to violet light-emitting LED chip mounted on a surface of a substrate. The globe has a shape in which a cross section in a direction in parallel to the surface of the substrate is circular. A phosphor screen emitting white light by absorbing the ultraviolet to violet light emitted from the LED chip is provided on an inner surface of the globe. The globe has a shape in which a diameter D1 at an attaching part to the base part is smaller than a diameter D2 at a maximum portion of the cross section.

14 Claims, 6 Drawing Sheets

(51) Int. Cl.

| | |
|---|---|
| ***F21V 3/00*** | (2015.01) |
| ***F21V 3/02*** | (2006.01) |
| ***F21V 3/04*** | (2006.01) |
| *F21Y 101/02* | (2006.01) |

(56) References Cited

U.S. PATENT DOCUMENTS

| | | | | |
|---|---|---|---|---|
| 8,796,915 | B2 * | 8/2014 | Ooya et al. | 313/503 |
| 2005/0029927 | A1 | 2/2005 | Setlur et al. | |
| 2007/0058357 | A1 | 3/2007 | Yamaguchi et al. | |
| 2008/0093615 | A1 * | 4/2008 | Lin et al. | 257/98 |
| 2009/0002603 | A1 | 1/2009 | Otsuka et al. | |
| 2010/0213881 | A1 | 8/2010 | Imai | |
| 2010/0289396 | A1 | 11/2010 | Osawa et al. | |
| 2010/0295464 | A1 | 11/2010 | Kasakura et al. | |
| 2011/0068687 | A1 | 3/2011 | Takahasi et al. | |
| 2012/0155059 | A1 | 6/2012 | Hoelen et al. | |

FOREIGN PATENT DOCUMENTS

| | | | |
|---|---|---|---|
| JP | 2009-170114 | A | 7/2009 |
| JP | 2009-238729 | A | 10/2009 |
| JP | 2010-004035 | A | 1/2010 |
| JP | 2010-016223 | A | 1/2010 |
| JP | 2010-027725 | A | 2/2010 |
| JP | 2010-199145 | A | 9/2010 |
| WO | WO 2009/087897 | A1 | 7/2009 |
| WO | WO 2010/090012 | A1 | 8/2010 |

OTHER PUBLICATIONS

Y. Ooya, U.S. PTO Notice of Allowance, U.S. Appl. No. 13/774,574, dated Mar. 27, 2014, 7 pages.

* cited by examiner

LIGHT DISTRIBUTION CURVE

LED LIGHT BULB

CROSS-REFERENCE TO RELATED APPLICATIONS

This application is a continuation of prior International Application No. PCT/JP2011/005073 filed on Sep. 9, 2011, which is based upon and claims the benefit of priority from Japanese Patent Application No. 2010-209142 filed on Sep. 17, 2010; the entire contents of all of which are incorporated herein by reference.

FIELD

Embodiments described herein relate to an LED light bulb.

BACKGROUND

A light-emitting device using a light-emitting diode (LED) is widely used for lighting devices such as a backlight of a liquid crystal display device, a signal apparatus, various kinds of switches, a lamp for a vehicle, and a general lighting. A white light-emitting LED lamp in which an LED and a phosphor are combined is focused as an alternative of an incandescent lamp, and development thereof is rapidly advanced. As a light bulb applying an LED lamp (hereinafter, noted as an LED light bulb), for example, one having an integral-type lamp structure is known. In the integral-type lamp, a globe is attached to a base part where a light bulb cap is provided, LED chips are disposed in the globe, further a lighting circuit of the LED chips is provided in the base part.

In a conventional LED light bulb, a combination of a blue light-emitting LED chip (blue LED) and a yellow phosphor (YAG phosphor and so on) emitting yellow light by absorbing blue light emitted from the blue LED is applied, and white light is obtained by a color mixture of the blue light emitted from the blue LED and the yellow light emitted from the yellow phosphor by absorbing the blue light. The LED light bulb in which the blue LED and the yellow phosphor are combined has characteristics in which brightness is easy to be secured. However, there is a difficult point in the white light based on the color mixture of the blue light from the blue LED and the yellow light from the yellow phosphor that it deteriorates in color rendering properties evaluated by an average color rendering index (Ra) and so on.

Light distribution of the LED light bulb in which the blue LED and the yellow phosphor are combined is inclined toward a blue component and a yellow component, and light of a red component is insufficient. Therefore, reflected light when an object is seen by the light from the LED light bulb is different from natural color when it is seen under sunlight. In the conventional LED light bulb, the light emitted from the blue LED is used for generation of the white light, and therefore, luminance of a whole of the light bulb becomes uneven. Accordingly, it is difficult to reduce garishness and local dazzle of the light bulb, so-called glare. The blue light emitted from the blue LED strongly tends to go straight, and the light going in a horizontal direction goes straight as it is and is not scattered around, and therefore, it is difficult to make so-called a light distribution angle enough large.

DETAILED DESCRIPTION

An LED light bulb according to an embodiment includes an LED module, a base part on which the LED module is disposed, and a globe attached to the base part to cover the LED module. The globe has a shape in which a cross section in a direction in parallel to a surface of a substrate is circular. The LED module includes an ultraviolet to violet light-emitting LED chip mounted on the substrate. A lighting circuit lighting the LED chip and a bayonet cap electrically connected to the lighting circuit are provided at the base part. The globe has a shape in which a diameter at an attaching part to the base part is smaller than a diameter at a maximum portion of the cross section.

Figure 1:
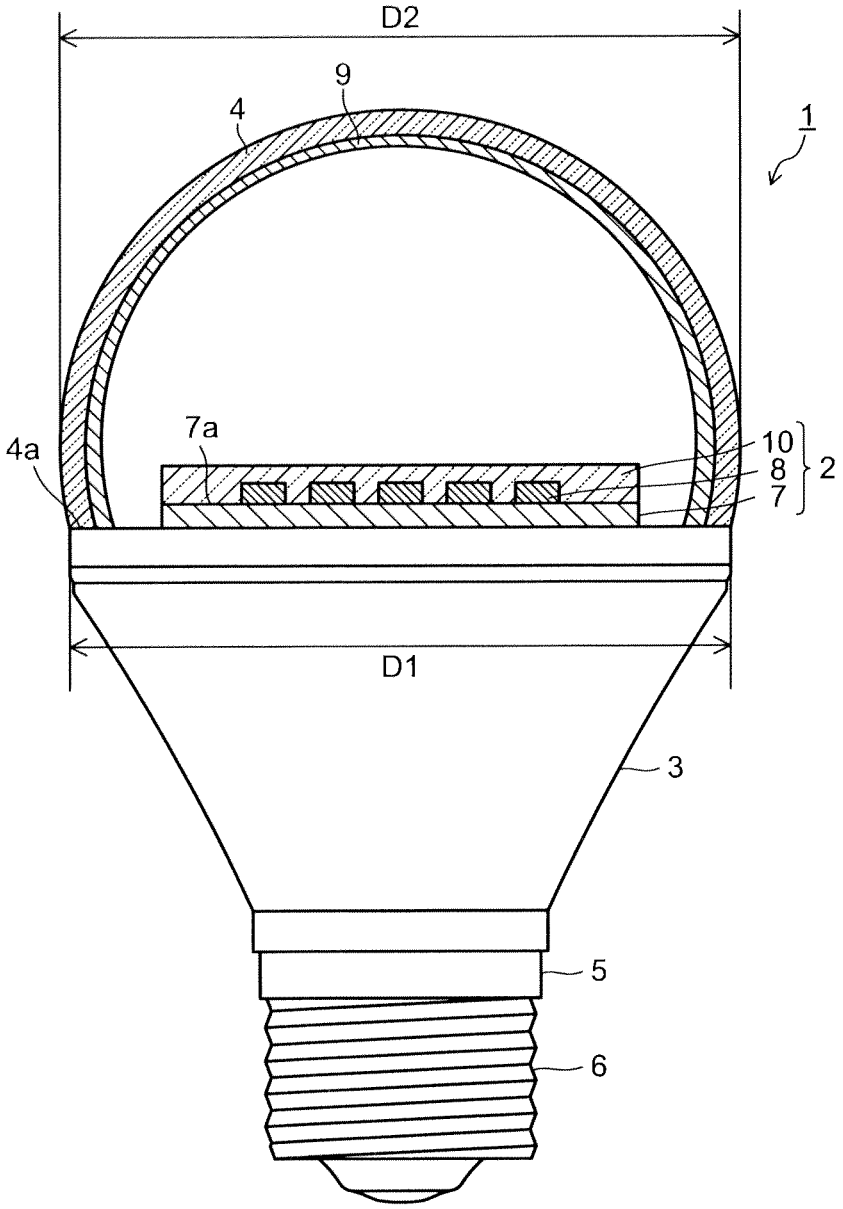
FIG. 1 is a view illustrating an LED light bulb according to a first embodiment by a partial cross section.
Figure 2:
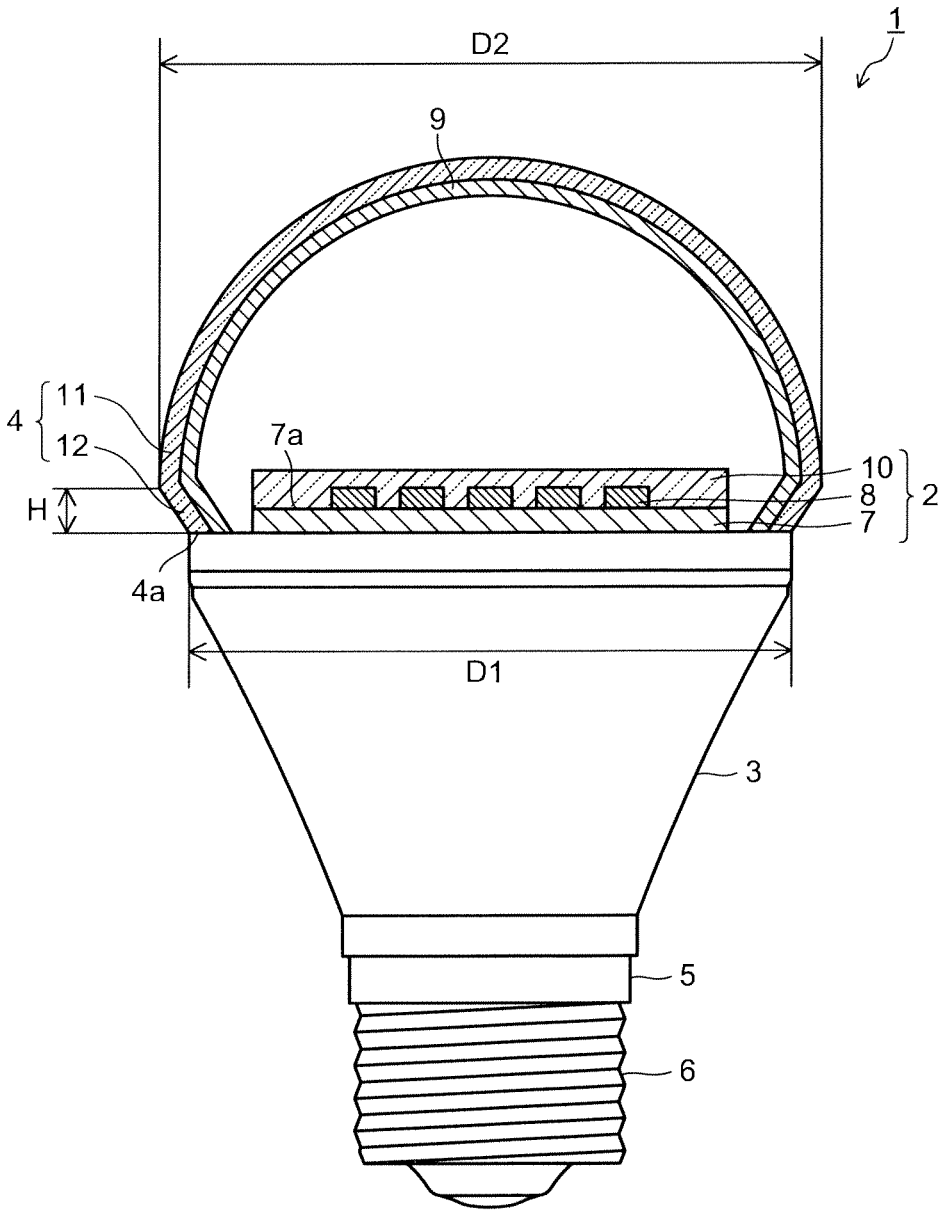
FIG. 2 is a view illustrating an LED light bulb according to a second embodiment by a partial cross section.
Figure 3:
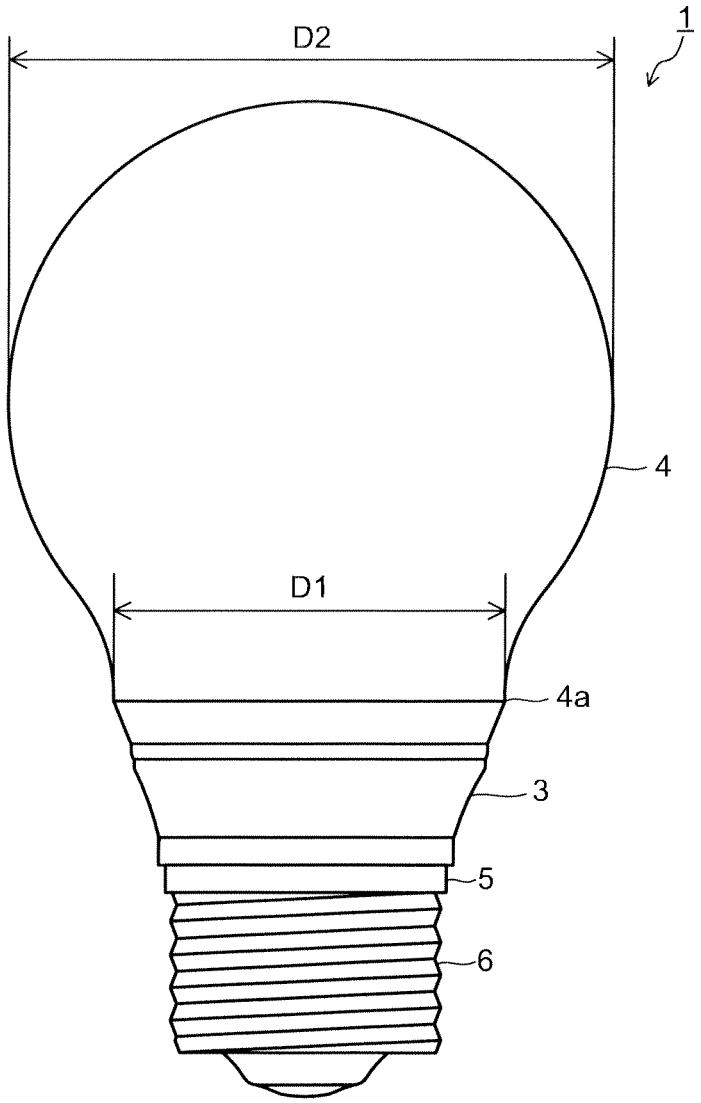
FIG. 3 is a view illustrating an LED light bulb according to a third embodiment.
Figure 4:
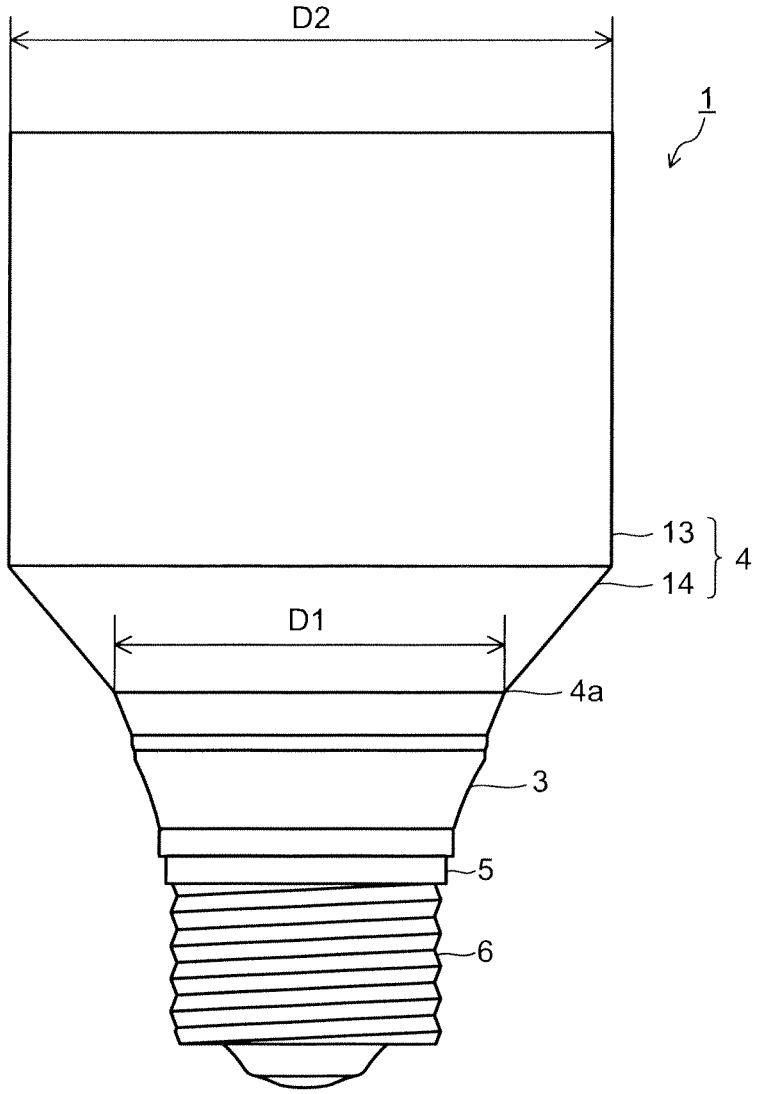
FIG. 4 is a view illustrating an LED light bulb according to a fourth embodiment.

Hereinafter, an LED light bulb according to an embodiment is described with reference to the drawings. FIG. 1 is a view illustrating an LED light bulb according to a first embodiment, FIG. 2 is a view illustrating an LED light bulb according to a second embodiment, FIG. 3 is a view illustrating an LED light bulb according to a third embodiment, and FIG. 4 is a view illustrating an LED light bulb according to a fourth embodiment. An LED light bulb 1 illustrated in these drawings includes an LED module 2, a base part 3 on which the LED module 2 is disposed, a globe 4 attached on the base part 3 to cover the LED module 2, a bayonet cap 6 attached at a lower end part of the base part 3 via an insulating member 5, and a lighting circuit (not-illustrated) provided in the base part 3.

The LED module 2 includes ultraviolet to violet light-emitting LED chips 8 mounted on a surface 7*a* of a substrate 7. The plural LED chips 8 are surface-mounted on the substrate 7. InGaN-based, GaN-based, AlGaN-based light-emitting diodes, and so on are used as the ultraviolet to violet light-emitting LED chip 8. A wiring network (not-illustrated) is provided at the surface 7*a* (further at inside according to need) of the substrate 7, and electrodes of the LED chips 8 are electrically connected to the wiring network of the substrate 7. A wiring which is not illustrated is drawn out at a side surface or a bottom surface of the LED module 2, and the wiring is electrically connected to the lighting circuit (not-illustrated) provided in the base part 3. The LED chip 8 is lighted by a direct-current voltage applied via the lighting circuit.

A phosphor screen (film) 9 emitting white light by absorbing ultraviolet to violet light emitted from the LED chips 8 is provided on an inner surface of the globe 4. An emission color of the LED light bulb 1 is determined by a combination of a light emission wavelength of the LED chip 8 and phosphors constituting the phosphor screen 9. When the white light is obtained by combining with the ultraviolet to violet light LED chip 8, it is preferable that the phosphor screen 9 is made of a mixed phosphor (BGR or BYR phosphor) containing a blue phosphor, a green to yellow phosphor, and a red phosphor. The mixed phosphor may further contain at least one phosphor selected from a blue-green phosphor and a deep red phosphor. The phosphor screen 9 includes the mixed phosphor capable of obtaining the white light only by the light-emission from itself (the light emitted from the LED chip 8 is not included).

It is preferable to use phosphors represented in the following from points of view of a combination with the ultraviolet to violet light from the LED chip 8, a color temperature, and color rendering properties (average color rendering index Ra and so on) of the obtained white light, as each of the phosphors constituting the BGR or BYR phosphor, or as the blue-green phosphor and the deep red phosphor to be added according to need. A phosphor of which light emission peak wavelength is within a range of 430 nm to 460 nm is used as the blue phosphor, and for example, it is preferable to use an europium (Eu) activated alkaline earth chlorophosphate phosphor having a composition represented by a formula (1).

General Formula:

$$(Sr_{1-x-y-z}Ba_xCa_yEu_z)_5(PO_4)_3\cdot Cl \quad (1)$$

where, x, y, and z are numbers satisfying 0 (zero)≤x<0.5, 0≤y<0.1, 0.005≤z<0.1.

A phosphor of which light emission peak wavelength is within a range of 490 nm to 580 nm is used as the green to yellow phosphor, and for example, it is preferable to use at least one selected from an europium (Eu) and manganese (Mn) activated alkaline earth aluminate phosphor having a composition represented by a formula (2), an europium (Eu) and manganese (Mn) activated alkaline earth silicate phosphor having a composition represented by a formula (3), a cerium (Ce) activated rare-earth aluminate phosphor having a composition represented by a formula (4), an europium (Eu) activated SiAlON phosphor having a composition represented by a formula (5), and an europium (Eu) activated SiAlON phosphor having a composition represented by a formula (6).

General Formula:

$$(Ba_{1-x-y-z}SR_xCa_yEu_z)(Mg_{1-u}Mn_u)Al_{10}O_{17} \quad (2)$$

where, x, y, z, and u are numbers satisfying 0≤x<0.2, 0≤y<0.1, 0.005<z<0.5, 0.1<u<0.5.

General Formula:

$$(Sr_{1-x-y-z-u}Ba_xMg_yEu_zMn_u)_2SiO_4 \quad (3)$$

where, x, y, z, and u are numbers satisfying 0.1≤x≤0.35, 0.025≤y<0.105, 0.025≤z≤0.25, 0.0005≤u≤0.02.

General Formula:

$$RE_3A_xAl_{5-x-y}B_yO_{12}:Ce_z \quad (4)$$

where, RE is at least one element selected from Y, Lu, and Gd, A and B are a pair of elements where (A, B) is any of (Mg, Si), (B, Sc), (B, In), and x, y, and z are numbers satisfying x<2, y<2, 0.9≤x/y≤1.1, 0.05≤z≤0.5.

General Formula:

$$(Si,Al)_6(O,N)_8:Eu_x \quad (5)$$

where, x is a number satisfying 0<x<0.3.

General Formula:

$$(Sr_{1-x}Eu_x)_\alpha Si_\beta Al_\gamma O_\delta N_\omega \quad (6)$$

where, x, α, β, γ, δ and ω are numbers satisfying 0<x<1, 0<α≤3, 12≤β≤14, 2≤γ≤3.5, 1<δ≤3, 20≤ω≤22.

A phosphor of which light emission peak wavelength is within a range of 580 nm to 630 nm is used as the red phosphor, and for example, it is preferable to use at least one selected from an europium (Eu) activated lanthanum sulfide phosphor having a composition represented by a formula (7), an europium (Eu) and bismuth (Bi) activated yttrium oxide phosphor having a composition represented by a formula (8), an europium (Eu) activated CASN phosphor having a composition represented by a formula (9), and an europium (Eu) activated SiAlON phosphor having a composition represented by a formula (10).

General Formula:

$$(La_{1-x-y}Eu_xM_y)_2O_2S \quad (7)$$

where, M is at least one element selected from Sm, Ga, Sb, and Sn, x and y are numbers satisfying 0.08≤x<0.16, 0.000001≤y<0.003.

General Formula:

$$(Y_{1-x-y}Eu_xBi_y)_2O_3 \quad (8)$$

where, x and y are numbers satisfying 0.01≤x<0.15, 0.001≤y<0.05.

General Formula:

$$Ca_{1-x-y}Sr_xEu_y)SiAlN_3 \quad (9)$$

where, x and y are numbers satisfying 0≤x<0.4, 0<y<0.5.

General Formula:

$$(Sr_{1-x}Eu_x)_\alpha Si_\beta Al_\gamma O_\delta N_\omega \quad (10)$$

where, x, α, β, γ, δ and ω are numbers satisfying 0<x<1, 0<α≤3, 5≤β≤9, 1≤γ≤5, 0.5≤δ≤2, 5≤ω≤15.

A phosphor of which light emission peak wavelength is within a range of 460 nm to 490 nm is used as the blue-green phosphor, and for example, it is preferable to use an europium (Eu) and manganese (Mn) activated alkaline earth silicate phosphor having a composition represented by a formula (11).

General Formula:

$$(Ba_{1-x-y-z-u}Sr_xMg_yEu_zMn_u)_2SiO_4 \quad (11)$$

where, x, y, z, and u are numbers satisfying 0.1≤x≤0.35, 0.025≤y≤0.105, 0.025≤z≤0.25, 0.0005≤u≤0.02.

A phosphor of which light emission peak wavelength is within a range of 630 nm to 780 nm is used as the deep red phosphor, and for example, it is preferable to use a manganese (Mn) activated magnesium fluorogermanate phosphor having a composition represented by a formula (12).

General Formula:

$$\alpha MgO\cdot\beta MgF_2\cdot(Ge_{1-x}Mn_x)O_2 \quad (12)$$

where, α, β, and x are numbers satisfying 3.0≤α≤4.0, 0.4≤β≤0.6, 0.001≤x≤0.5.

A ratio of each phosphor constituting the mixed phosphor is appropriately set in accordance with an emission color and so on of the LED light bulb 1, but for example, it is preferable for the mixed phosphor to contain the blue phosphor within a range of 10 mass % to 60 mass %, the blue-green phosphor within a range of 0 (zero) mass % to 10 mass %, the green to yellow phosphor within a range of one mass % to 30 mass %, the red phosphor within a range of 30 mass % to 90 mass %, and the deep red phosphor within a range of 0 (zero) mass % to 35 mass %. According to the mixed phosphor as stated above, it is possible to obtain the white light of a wide range of which correlated color temperature is 6500 K to 2500 K by the same kind of phosphor.

The phosphor screen (film) 9 is formed by, for example, mixing a powder of the mixed phosphor with a binder resin and so on, this mixture (for example, slurry) is coated on the inner surface of the globe 4, and thereafter, heated and cured. The mixed phosphor powder is preferable to have an average particle size (a median of a particle size distribution (D50)) within a range of 3 μm to 50 μm. The mixed phosphor (phosphor particle) having the average particle size as stated above is used, and thereby, it is possible to increase an absorption efficiency of the ultraviolet to violet light emitted from the LED chip 8, and to improve the luminance of the LED light bulb 1.

A thickness of the phosphor screen (film) 9 is preferable to be within a range of 80 μm to 800 μm. When the ultraviolet to violet light-emitting LED chips 8 are used as an excitation source of the phosphor screen 9, it is preferable to suppress a leakage of ultraviolet ray from the globe 4. There is a possibility in which the ultraviolet ray leaked from the globe 4 has an adverse affect on printed matters, foods, chemicals, human bodies, and so on existing in a vicinity and a disposition space of the LED light bulb 1. When the film thickness of the phosphor screen 9 is less than 80 μm, a leakage amount of the ultraviolet ray becomes large. On the other hand, when the film thickness of the phosphor screen 9 exceeds 800 μm, brightness of the LED light bulb 1 is lowered. According to the phosphor screen 9 of which film thickness is 80 μm to 800 μm, it is possible to suppress the lowering of the brightness of the LED light bulb 1 while reducing the amount of the ultraviolet ray (an energy amount of the ultraviolet ray) leaked from the globe 4 to, for example, 0.3 mW/nm/lm or less. It is more preferable that the film thickness of the phosphor screen 9 is within a range of 150 μm to 600 μm.

The phosphor screen 9 in the LED light bulb 1 according to the present embodiment is provided at the inner surface of the globe 4 so as to be separated from the LED chips 8, different from a conventional LED module in which phosphor particles are dispersed in a sealing resin of LED chip. Electric energy applied on the LED light bulb 1 is converted into the ultraviolet to violet light at the LED chip 8, and further converted into longer-wavelength light at the phosphor screen 9 to be emitted as white light. The white light emitted from the LED light bulb 1 is constituted only by the light-emission of the phosphor screen 9 different from the conventional LED light bulb in which the blue LED and the yellow phosphor are combined.

In the LED light bulb 1, the phosphor screen 9 provided at a whole of the inner surface of the globe 4 emits light, and therefore, a surface emission of the whole of the phosphor screen 9 is enabled, and the white light spreads from the phosphor screen 9 in all directions which is different from the conventional LED module in which the phosphor particles are dispersed in the sealing resin. Further, the white light is obtained only by the light-emission from the phosphor screen 9 which is different from the conventional LED light bulb in which the blue LED and the yellow phosphor are combined, and therefore, it is possible to suppress local luminance unevenness, or the like. It is thereby possible to obtain the white light without glare, even and soft. Namely, it is possible to drastically reduce the glare of the LED light bulb 1 compared to the conventional LED light bulb in which the blue LED and the yellow phosphor are combined.

When the ultraviolet to violet light-emitting LED chips 8 are used as the excitation source of the LED light bulb 1, it is possible to constitute the phosphor screen 9 with various phosphors which is different from the conventional LED light bulb in which the blue LED and the yellow phosphor are combined. Namely, a range of selection of the kinds of phosphors constituting the phosphor screen 9 becomes wider, and therefore, it is possible to increase the color rendering properties and so on of the white light emitted from the LED light bulb 1. Specifically, the white light of which correlated color temperature is 6500 K or less, and the average color rendering index (Ra) is 85 or more can be easily obtained. The white light as stated above is obtained, and thereby, it becomes possible to improve practicality and so on of the LED light bulb 1 as an alternative of the incandescent lamp.

The ultraviolet to violet light-emitting type LED (emission peak wavelength: 350 nm to 430 nm) may be used as the LED chip 8, and particularly, it is preferable to use the LED chip 8 of which emission peak wavelength is within a range of 370 nm to 415 nm and a half value width of an emission spectrum is 10 nm to 15 nm. When the LED chip 8 as stated above and the phosphor screen 9 constituted by the above-stated mixed phosphor (a mixed phosphor of BGR or BYR phosphor, further the blue-green phosphor and the deep red phosphor are added according to need) are combined to be used, the white light of which correlated color temperature (emission color) is stable independent from an output variation of the LED chip 8 can be obtained, and it is possible to improve yield of the LED light bulb 1. In the conventional combination of the blue LED and the yellow phosphor, the output variation of the LED chip directly affects on the correlated color temperature (emission color), and therefore, the yield of the LED light bulb is easy to be lowered.

The plural LED chips 8 surface-mounted on the substrate 7 are preferable to be covered with a transparent resin layer 10. Namely, the LED module 2 is preferable to include the plural LED chips 8 surface-mounted on the substrate 7 and the transparent resin layer 10 provided on the substrate 7 so as to cover the plural LED chips 8. For example, a silicon resin, an epoxy resin, and so on are used for the transparent resin layer 10, and it is particularly preferable to use the silicon resin excellent in ultraviolet light resistant properties. As stated above, the plural LED chips 8 are covered with the transparent resin layer 10, and thereby, the lights emitted from each of the LED chips 8 propagate with each other, local strong and weak of light to be a cause of the glare is softened, and a taking out efficiency of light can be increased.

It is preferable to form the globe 4 with a material having a transparent or white body color of which transmittance of visible light is 80% or more, for example, a glass or a resin. It is thereby possible to effectively take out the white light emitted from the phosphor screen 9 toward outside of the light bulb. The globe 4 has, for example, a dome shape as illustrated in FIG. 1. The dome shape illustrated in FIG. 1 is a shape where a cross section in a direction in parallel to the surface 7*a* of the substrate 7 (a first cross section) is circular, and a diameter D1 at an attaching part 4*a* to the base part 3 is smaller than a diameter D2 at a maximum portion of the first cross section. The globe 4 illustrated in FIG. 1 has a shape in which a part of a hemisphere positioning at downward from a plane containing a center of a spherical body (a plane containing a great circle/a central plane) is cut in parallel to the central plane, and an end after cutting is the attaching part 4*a*.

The phosphor screen 9 emitting white light is provided on the inner surface of the globe 4 having the shape as stated above, and thereby, it is possible to make the light distribution angle of the LED light bulb 1 large, and in addition, it is possible to suppress luminance deterioration over time resulting from a temperature increase and so on of the phosphor screen 9. The light distribution angle represents a spread of light to a periphery of the light bulb, and when the light distribution angle is small, it is felt that brightness is insufficient as a whole of the light bulb even when luminance just under the light bulb is high. The light distribution angle in the present embodiment is obtained as follow. An angle where luminance becomes a half relative to center luminance of the light bulb is found as for right and left both sides, and both angles are summed up. When right and left are symmetrical, the light distribution angle becomes a double value of one side angle.

Figure 6:
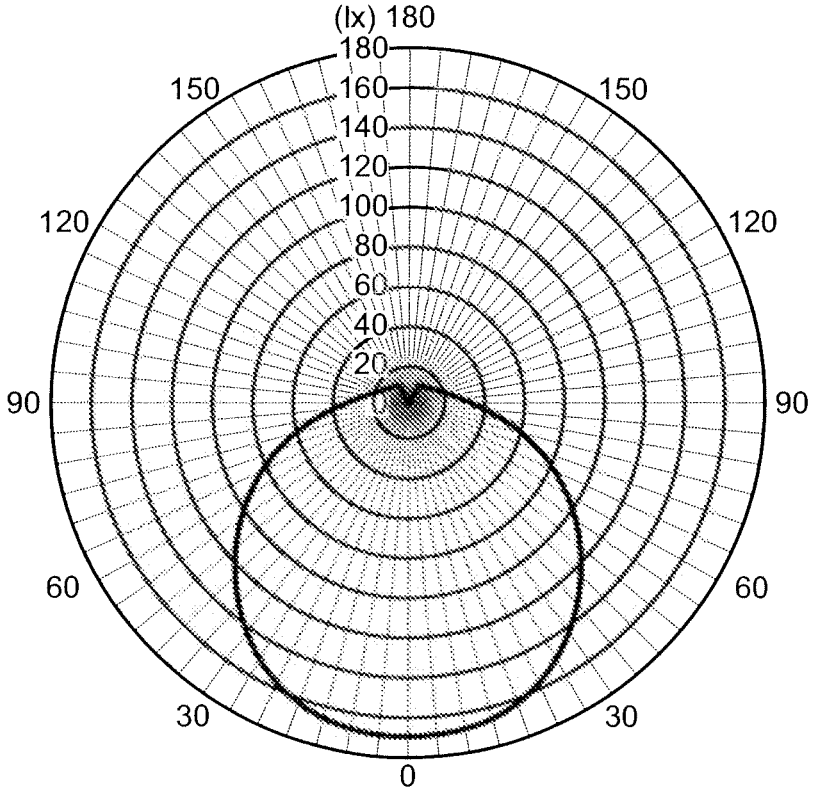
FIG. 6 is a view illustrating an example of a light distribution angle of the LED light bulb of which LED chips are covered with a resin layer containing a phosphor.

In a conventional light bulb structure in which LED chips are covered with a resin layer containing a phosphor, an energy emitted from the LED chip is converted into visible light by the phosphor in the resin layer, and this visible light disperses in various directions from the resin layer. Note that light going horizontally relative to the surface of the substrate where the LED chips are mounted goes straight as it is and the light does not spread to a rear side of the substrate (at downward of the substrate). Accordingly, the light distribution angle of the LED light bulb in which the LED chips are covered with the resin layer containing the phosphor is approximately 120 degrees as illustrated in FIG. 6.

Further, when the phosphor screen constituted by the yellow phosphor and so on is formed at the inner surface of the globe in the conventional LED light bulb in which the blue LED, the yellow phosphor, and so on are combined, the light-emission from the phosphor screen disperses to the periphery, and therefore, the light distribution angle becomes larger than the LED light bulb in which the LED chips are covered with the resin layer containing the phosphor. However, the light emitted from the blue LED constituting a part of the white light has a strong going-straight property, transmits the globe and is emitted toward outside under the state, and therefore, the light does not spread to the rear side of the substrate (at downward of the substrate). Accordingly, there is a limit in improvement of the light distribution angle of the LED light bulb.

On the other hand, the whole of the phosphor screen 9 provided on the inner surface of the globe 4 is surface-emitted and the white light is obtained only by the light-emission from the phosphor screen 9 in the LED light bulb 1 according to the embodiment, and therefore, the white light spreads from the phosphor screen 9 in all directions. Namely, all of light-emission components constituting the white light are emitted at an inner side of the globe 4, and the white light is diffused from the whole surface of the phosphor screen 9 to the periphery, and therefore, the spread of the white light in itself to a rear surface of the light bulb becomes large.

Figure 5:
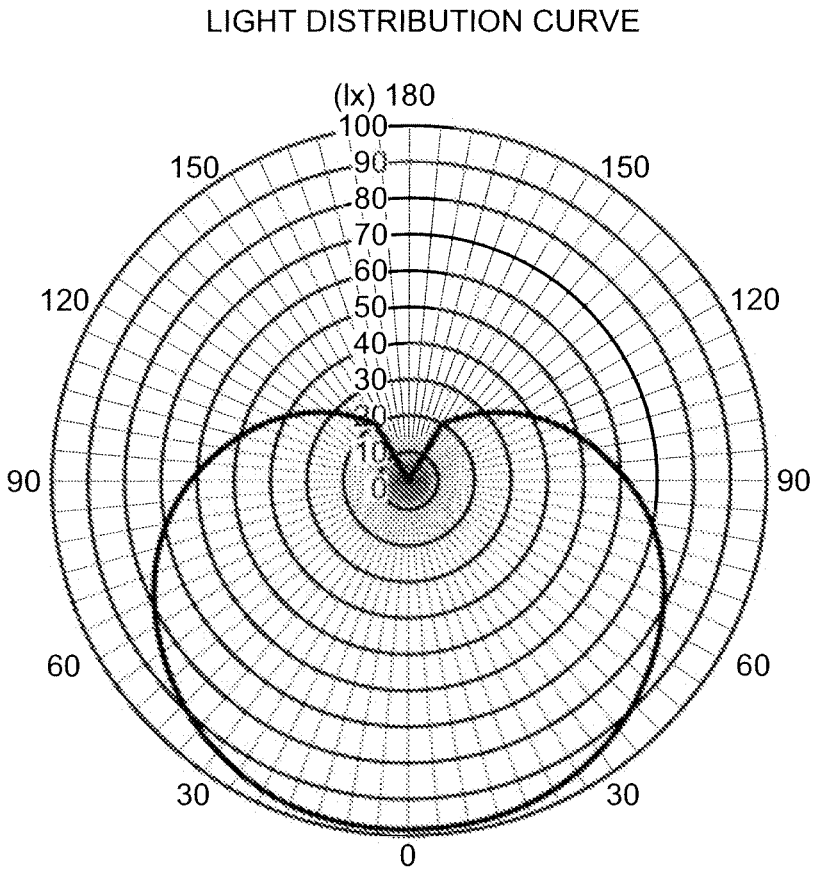
FIG. 5 is a view illustrating an example of a light distribution angle of the LED light bulb according to the embodiment.

Further, the globe 4 has a shape in which the diameter D1 at the attaching part 4*a* to the base part 3 is smaller than the diameter D2 at the maximum portion of the first cross section. Namely, the globe 4 has a shape narrowing down toward the attaching part 4*a*, and therefore, the spread of the white light in a rear surface direction becomes larger. Accordingly, it becomes possible to more make the light distribution angle of the white light of the LED light bulb 1 large as illustrated in FIG. 5. According to the LED light bulb 1 of the present embodiment, it is possible to set the light distribution angle at, for example, 180 degrees or more, further, to set it at 200 degrees or more.

The globe 4 having a dome shape illustrated in FIG. 2 is more effective to improve the light distribution angle of the LED light bulb 1. The globe 4 illustrated in FIG. 2 has a hemispherical dome portion 11, and a narrowing portion 12 connecting the dome portion 11 and the attaching part 4*a* to the base part 3. Edges of a cross section of the narrowing portion 12 in a direction perpendicular to the surface 7*a* of the substrate 7 (a cross section illustrated in FIG. 2/a second cross section) has a straight shape, and it is thereby possible to narrow down the shape of the globe 4 more largely and to turn a part of the globe 4 to the rear surface direction. A connection part of the hemispherical dome portion 11 with the narrowing portion 12 has the maximum diameter D2.

According to the globe 4 having the dome portion 11 and the narrowing portion 12 as stated above, it is possible to make a protrusion amount (overhang amount) of the dome portion 11 from the base part 3 large, and to turn a part of the phosphor screen 9 formed on the inner surface of the globe 4 to the rear surface direction more effectively while suppressing an increase in an entire shape of the globe 4. It is thereby possible to effectively make the light distribution angle of the white light emitted from the LED light bulb 1 large.

The globe 4 illustrated in FIG. 2 is more preferable to have a shape in which a ratio (D2/D1) of the maximum diameter (the diameter at the maximum portion of the first cross section) D2 of the dome portion 11 relative to the diameter D1 at the attaching part 4*a* is within a range of 1.07 to 1.61, and a ratio (H/(D2−D1)) of a height H of the narrowing portion 12 relative to a difference (D2−D1) between the maximum diameter D2 and the diameter D1 at the attaching part 4*a* is within a range of 0.147 to 3.125. The globe 4 having the shape as stated above is applied, and thereby, it is possible to effectively make the light distribution angle of the white light emitted from the LED light bulb 1 larger.

When the D2/D1 ratio is less than 1.07, there is a possibility in which an enlarging effect of the light distribution angle by the narrowing portion 12 cannot be fully obtained. On the other hand, when the D2/D1 ratio exceeds 1.61, it is impossible to expect a further increase of the effect, and in addition, there is a possibility in which practicality is lowered because the entire shape of the LED light bulb 1 is enlarged. When the H/(D2−D1) ratio is less than 0.147, there is a possibility in which an enlarging effect of the light distribution angle is lowered because the white light cannot be effectively turned to the rear surface direction. On the other hand, when the H/(D2−D1) ratio exceeds 3.125, it is impossible to expect a further increase of the effect, and in addition, the practicality is lowered because the entire shape of the LED light bulb 1 is enlarged. The D2/D1 ratio is more preferable to be within a range of 1.07 to 1.43, and the H/D2−D1) ratio is more preferable to be within a range of 0.294 to 1.7.

It is similarly preferable for the globe 4 illustrated in FIG. 1 to have a shape in which the ratio (D2/D1) of the maximum diameter D2 of the globe 4 relative to the diameter D1 at the attaching part 4*a* is within a range of 1.07 to 1.61. The globe 4 having the shape as stated above is applied, and thereby, it is possible to effectively make the light distribution angle of the white light emitted from the LED light bulb 1 large. When the D2/D1 ratio is less than 1.07, there is a possibility in which the enlarging effect of the light distribution angle cannot be fully obtained. When the D2/D1 ratio exceeds 1.61, it is impossible to expect the further increase of the effect, and in addition, there is a possibility in which the practicality is lowered because the entire shape of the LED light bulb 1 is enlarged.

Concrete shapes of the dome portion 11 and the narrowing portion 12 are preferable to be appropriately selected in accordance with kinds of a bayonet cap 6, and so on. For example, in case of the LED light bulb 1 having an E26 cap which is used for a general light bulb, it is preferable that the maximum diameter D2 is within a range of 60 mm to 90 mm. The diameter D1 at the attaching part 4*a* at this time is preferable to be within a range of 40 mm to 84 mm, and the height H of the narrowing portion 12 is preferable to be within a range of 5 mm to 45 mm. Besides, in case of the LED light bulb 1 having an E17 cap, and so on used for a small-sized light bulb, it is preferable to apply a shape having a similar ratio in accordance with the bayonet cap.

As for the luminance deterioration over time resulting from the temperature increase and so on of the phosphor screen 9, the temperature of the phosphor is easy to increase based on the temperature increase of the LED chips when the LED light bulb is continuously lighted in the conventional structure in which the LED chips are covered with the resin layer containing the phosphor. Accordingly, the luminance deterioration resulting from the temperature increase of the phosphor is easy to occur. On the other hand, the phosphor screen 9 is provided on the inner surface of the globe 4 to be separated from the LED chips 8, and thereby, it is possible to suppress the temperature increase of the phosphor screen 9 even when the temperature of the LED chips 8 increases. For example, the temperature of the phosphor screen 9 increases up to approximately around 60° C. when there is an enough distance between the phosphor screen 9 and the LED chips 8. Accordingly, it is possible to suppress the luminance deterioration over time during the lighting time of the LED light bulb 1.

The above-stated shape of the globe 4 in which the diameter D1 at the attaching part 4*a* to the base part 3 is smaller than the diameter D2 at the maximum portion is not limited to the dome shapes illustrated in FIG. 1 and FIG. 2. For example, the globe 4 having an eggplant shape as illustrated in FIG. 3 and a cylindrical shape as illustrated in FIG. 4 can be applied. In the globe 4 having the eggplant shape as illustrated in FIG. 3, the diameter D1 at the attaching part 4*a* is smaller than the diameter D2 at the maximum portion based on the eggplant shape. The globe 4 having the cylindrical shape as illustrated in FIG. 4 has a narrowing portion 14 connecting a cylindrical part 13 and the attaching part 4*a*, and thereby, the diameter D1 at the attaching part 4*a* is smaller than the diameter D2 at the maximum portion.

The LED light bulb 1 according to the embodiment is manufactured by, for example, as described below. At first, a phosphor slurry containing the phosphor powder is prepared. The phosphor slurry is prepared by, for example, mixing the phosphor powder with a binder resin such as a silicon resin, an epoxy resin, a polyurethane resin, and a filler such as alumina, silica. A mixing ratio of the phosphor and the binder resin is appropriately selected depending on the kind and the particle size of the phosphor, but for example, when the phosphor is set to be 100 parts by mass, it is preferable that the binder resin is within a range of 20 parts by mass to 1000 parts by mass. It is preferable to appropriately set the kind, the average particle size, the mixing ratio, and so on of the phosphor according to target white light from the above-stated condition ranges.

Next, the phosphor slurry is coated on the inner surface of the globe 4. The coating of the phosphor slurry is performed by, for example, a spray method, a dip method, a method rotating the globe 4, or the like to evenly coat on the inner surface of the globe 4. A coating film of the phosphor slurry is heated and dried by using a heating apparatus such as a drier and an oven, to thereby form the phosphor screen (film) 9 on the inner surface of the globe 4. After that, the globe 4 having the phosphor screen 9 is attached to the base part 3 equipped with the LED module 2, the bayonet cap 6, and so on, and thereby, a target LED light bulb 1 is manufactured.

EXAMPLES

Next, concrete examples and evaluation results thereof are described.

Example 1

At first, an Eu activated alkaline earth chlorophosphate ($(Sr_{0.604}Ba_{0.394}Eu_{0.002})_5(PO_4)_3Cl$) phosphor of which average particle size is 40 μm is prepared as the blue phosphor, an Eu and Mn activated alkaline earth silicate ($(Sr_{0.675}Ba_{0.25}Mg_{0.0235}Eu_{0.05}Mn_{0.0015})_2SiO_4$) phosphor of which average particle size is 17 μm is prepared as the green to yellow phosphor, and an Eu activated lanthanum sulfide ($(La_{0.9}Eu_{0.1})_2O_2S$) phosphor of which average particle size is 45 μm is prepared as the red phosphor. These phosphors are mixed such that a ratio of the blue phosphor, the green to yellow phosphor, and the red phosphor becomes 17.6:4.1:78.3 in mass ratio to prepare a mixed phosphor (BGR phosphor).

Next, the globe of which shape is illustrated in FIG. 1 is prepared. The globe is made up of a translucent polycarbonate resin of which transmittance of visible light is 88%, and has a dome shape of which thickness is approximately 1 mm, diameter D2 at the maximum portion is 63 mm, and diameter D1 at the attaching part to the base part is 59 mm. The phosphor screen is formed at the inner surface of the above-stated globe as described below. At first, the above-stated mixed phosphor is dispersed in the silicon resin as the binder resin and it is deaerated. Next, the phosphor slurry having the amount to be a desired film thickness is input into the globe, and the globe is rotated while changing an angle thereof so that the phosphor slurry evenly spreads at the inner surface of the globe. Next, the heating is performed by using an infrared heater, a drier, and so on until the phosphor slurry begins to be cured and the coating film does not flow. After that, a heat treatment is performed with a condition of approximately 100° C.×five hours by using an oven and so on to completely cure the coating film of the phosphor slurry.

As for the LED module, it is constituted such that 112 pieces of LED chips each of which light emission peak wavelength is 405 nm, half value width of the emission spectrum is 15 nm are used, these LED chips are surface-mounted on the substrate, further, they are coated with the silicon resin. Besides, one having the E26 cap is prepared as the base part. The LED light bulb is assembled by using these components. Property evaluations as described below are performed for the LED light bulb obtained as stated above.

Examples 2 to 22

The plural globes each having a shape illustrated in FIG. 2 are prepared. Concrete shapes of these globes, namely, the diameter D2 at the maximum portion, the diameter D1 at the attaching part to the base part, and the height H of the narrowing portion are as illustrated in Table 1. The LED light bulbs are manufactured as same as the example 1 except that the globes as stated above are used. Property evaluations as described below are performed for these LED light bulbs.

Comparative Example 1

The LED light bulb is manufactured as same as the example 1 except that the globe having the same shape as the example 2 is used, and an Ce activated rare-earth aluminate phosphor (yellow phosphor) is dispersed in the resin layer covering the blue light-emitting LED chips (light emission peak wavelength: 450 nm). The phosphor screen is not formed at the inner surface of the globe. Property evaluations as described below are performed for this LED light bulb.

Comparative Examples 2 to 5

The LED light bulbs are manufactured as same as the example 1 except that the globe having the same shape as the examples 2 to 5 is used, and the mixed phosphor as same as the example 1 is dispersed in the resin layer covering the same LED chips (light emission peak wavelength: 405 nm) as the example 1. The phosphor screen is not formed at the inner surface of the globe. Property evaluations as described below are performed for these LED light bulbs.

Next, the light distribution angles of respective LED light bulbs of the examples 1 to 22 and the comparative examples 1 to 5 are measured by an illuminometer T-10 manufactured by Konica-Minolta. Besides, glare of each LED light bulb is evaluated by visual observation. These measurement and evaluation results are illustrated in Table 1. The glare is relatively evaluated by three stages of A, B, and C. A correlated color temperature, brightness, an average color rendering index Ra of white light emitted at the lighting time of each LED light bulb are measured, then the LED light bulb according to each example has the correlated color temperature of 2700 K, the brightness of 50 l/W, and the average color rendering index Ra of 94. On the other hand, the LED light bulb according to the comparative example 1 has the correlated color temperature of 5000 K, the brightness of 89 l/W, and the average color rendering index Ra of 70.

TABLE 1

| | Shape of Globe | | | | | | Formation position of | Light distribution | |
|---|---|---|---|---|---|---|---|---|---|
| | Entire shape | D2 (mm) | D1 (mm) | H (mm) | D2/D1 | H/(D2 − D1) | phosphor screen | angle (degree) | Glare |
| Example 1 | FIG. 1 | 63 | 56 | — | 1.07 | — | Globe inner surface | 185 | A |
| Example 2 | FIG. 2 | 60 | 56 | 5 | 1.07 | 1.250 | Globe inner surface | 200 | A |
| Example 3 | FIG. 2 | 60 | 56 | 7.5 | 1.07 | 1.875 | Globe inner surface | 197 | A |
| Example 4 | FIG. 2 | 60 | 56 | 10 | 1.07 | 2.500 | Globe inner surface | 190 | A |
| Example 5 | FIG. 2 | 60 | 56 | 12.5 | 1.07 | 3.125 | Globe inner surface | 181 | A |
| Example 6 | FIG. 2 | 70 | 56 | 5 | 1.25 | 0.357 | Globe inner surface | 196 | A |
| Example 7 | FIG. 2 | 70 | 56 | 7.5 | 1.25 | 0.536 | Globe inner surface | 213 | A |
| Example 8 | FIG. 2 | 70 | 56 | 10 | 1.25 | 0.714 | Globe inner surface | 222 | A |
| Example 9 | FIG. 2 | 70 | 56 | 12.5 | 1.25 | 0.893 | Globe inner surface | 217 | A |
| Example 10 | FIG. 2 | 80 | 56 | 5 | 1.43 | 0.208 | Globe inner surface | 190 | A |
| Example 11 | FIG. 2 | 80 | 56 | 7.5 | 1.43 | 0.313 | Globe inner surface | 206 | A |
| Example 12 | FIG. 2 | 80 | 56 | 10 | 1.43 | 0.417 | Globe inner surface | 216 | A |
| Example 13 | FIG. 2 | 80 | 56 | 12.5 | 1.43 | 0.521 | Globe inner surface | 228 | A |
| Example 14 | FIG. 2 | 90 | 56 | 5 | 1.61 | 0.147 | Globe inner surface | 180 | A |
| Example 15 | FIG. 2 | 90 | 56 | 7.5 | 1.61 | 0.221 | Globe inner surface | 191 | A |
| Example 16 | FIG. 2 | 90 | 56 | 10 | 1.61 | 0.294 | Globe inner surface | 203 | A |
| Example 17 | FIG. 2 | 90 | 56 | 12.5 | 1.61 | 0.368 | Globe inner surface | 194 | A |
| Example 18 | FIG. 2 | 60 | 40 | 23 | 1.50 | 1.150 | Globe inner surface | 298 | A |
| Example 19 | FIG. 2 | 60 | 45 | 20 | 1.33 | 1.333 | Globe inner surface | 266 | A |
| Example 20 | FIG. 2 | 60 | 50 | 17 | 1.20 | 1.700 | Globe inner surface | 232 | A |
| Example 21 | FIG. 2 | 90 | 84 | 5 | 1.07 | 0.833 | Globe inner surface | 266 | A |
| Example 22 | FIG. 2 | 90 | 50 | 50 | 1.80 | 1.250 | Globe inner surface | 273 | A |
| Comparative Example 1 | FIG. 2 | 60 | 56 | 5 | 1.07 | 1.250 | Within LED coating resin* | 129 | C |
| Comparative Example 2 | FIG. 2 | 60 | 56 | 5 | 1.07 | 1.250 | Within LED coating resin | 134 | B |
| Comparative Example 3 | FIG. 2 | 60 | 56 | 7.5 | 1.07 | 1.875 | Within LED coating resin | 130 | B |
| Comparative Example 4 | FIG. 2 | 60 | 56 | 10 | 1.07 | 2.500 | Within LED coating resin | 124 | B |
| Comparative Example 5 | FIG. 2 | 60 | 56 | 12.5 | 1.07 | 3.125 | Within LED coating resin | 114 | B |

*Blue LED + Yellow Phosphor

As it is obvious from Table 1, the light distribution angle is large and the glare is small in the LED light bulbs according to the examples 1 to 22. In particular, the globe having the shape illustrated in FIG. 2 is used, and thereby, it is possible to more effectively make the light distribution angle large. On the other hand, it can be seen that the light distribution angle is small and the reduction in glare is not enough in the LED light bulbs according to the comparative examples 1 to 5 in which the phosphor is dispersed in the resin layer covering the LED chips.

Incidentally, the above-described embodiments are to be considered in all respects as illustrative and no restrictive. Namely, these novel embodiments can be carried out in various other forms, and various omissions, substitutions, and changes can be made therein without departing from the spirit of the invention. These embodiments and modifications thereof are included in the scope and the spirit of the invention and included in the inventions described in the claims and the scope of equivalents of the inventions.

What is claimed is:

1. An LED light bulb, comprising:

an LED module including a substrate and an ultraviolet to violet light-emitting LED chip mounted on a surface of the substrate;

a base part on which the LED module is disposed;

a globe including an attaching part attached on the base part to cover the LED module, and having a shape in which a cross section in a direction in parallel to the surface of the substrate is circular;

a phosphor screen, provided on an inner surface of the globe separately from the LED chip, emitting white light by absorbing ultraviolet to violet light emitted from the LED chip;

a lighting circuit provided in the base part and lighting the LED chip; and a bayonet cap electrically connected to the lighting circuit, wherein the globe has a dome shape in which a diameter Dl at the attaching part is smaller than a diameter D2 at a maximum portion of the cross section, and a ratio D2/D1 of the diameter D2 to the diameter D1 is in a range of from 1.07 to 1.61.

2. The LED light bulb according to claim 1, wherein the globe has a hemispherical dome portion, le attaching part to the base part, and a narrowing portion provided to connect the dome portion and the attaching part and of which edges of a cross section in a direction perpendicular to the surface of the substrate is straight.

3. The LED light bulb according to claim 2, wherein the globe has a shape in which H(D2−D1) is in a range of 0.147 to 3.125, where H is a height of the narrowing portion.

4. The LED light bulb according to claim 1, wherein the globe has a dome portion having a shape in which a part of a hemispheric part at downward from a plane containing a center of a spherical body is cut in parallel to the plane, and the attaching part provided at an end part of the dome portion.

5. The LED light bulb according to claim 1, wherein a light distribution angle of the white light emitted from the LED light bulb is 180 degrees or more.

6. The LED light bulb according to claim 1, wherein the globe is made of a material having a body color of transparent or white, and of which transmittance of visible light is 80% or more.

7. The LED light bulb according to claim 1, wherein the ultraviolet to violet light has a emission peak wavelength in a range of 370 nm or more and 415 nm or less, and a half value width of emission spectrum in a range of 10 nm or more and 15 nm or less.

8. The LED light bulb according to claim 1,

Wherein the LED module includes a plurality of the LED chips mounted on the surface of the substrate and a transparent resin layer provided on the surface of the substrate to cover the plurality of LED chips.

9. The LED light bulb according to claim 1, wherein the phosphor screen includes a blue phosphor, a green to yellow phosphor, and a red phosphor.

10. The LED light bulb according to claim 9, wherein the blue phosphor includes an europium activated alkaline earth chlorophosphate phosphor having a composition represented by a general formula:

$$(Sr_{1-x-y-z}Ba_xCa_yEu_z)_5(PO_4)_3Cl$$

where, x, y, and z are numbers satisfying $0 \le x < 0.5$, $0 \le y < 0.1$, $0.005 \le z < 0.1$, wherein the green to yellow phosphor includes at least one selected from: an europium and manganese activated alkaline earth aluminate phosphor having a composition represented by a general formula:

$$(Ba_{1-x-y-z}Sr_xCa_yEu_z)(Mg_{1-u}Mn_u)Al_{10}O_{17}$$

where, x, y, z, and u are numbers satisfying $0 \le x < 0.2$, $0 \le y < 0.1$, $0.005 < z < 0.5$, $0.1 < u < 0.5$;

an europium and manganese activated alkaline earth silicate phosphor having a composition represented by a general formula:

$$(Sr_{1-x-y-z-u}Ba_xMg_yEu_zMn_u)_2SiO_4$$

where, x, y, z, and u are numbers satisfying $0.1 \le x \le 0.35$, $0.025 \le y < 0.105$, $0.025 \le z \le 0.25$, $0.0005 \le u \le 0.02$;

a cerium activated rare-earth aluminate phosphor having a composition represented by a general formula:

$$RE_3A_xAl_{5-x-y}B_yO_{12}:Ce_z$$

where, RE is at least one element selected from Y, Lu, and Gd, A and B are a pair of elements where (A, B) is any of (Mg, Si), (B, Sc), (B, In), and x, y, and z are numbers satisfying $x < 2$, $y < 2$, $0.9 \le x/y \le 1.1$, $0.05 \le z \le 0.5$;

an europium activated SiAlON phosphor having a composition represented by a general formula:

$$(Si,Al)_6(O,N)_8:Eu_x$$

where, x is a number satisfying $0 < x < 0.3$; and an europium activated SiAlON phosphor having a composition represented by a general formula:

$$(Sr_{1-x}Eu_x)_\alpha Si_\beta Al_\gamma O_\delta N_\omega$$

where, x, α, β, γ, δ and ω are numbers satisfying $0 < x < 1$, $0 < \alpha \le 3$, $12 \le \beta \le 14$, $2 \le \gamma \le 3.5$, $1 \le \delta \le 3$, $20 \le \omega \le 22$, and wherein the red phosphor is at least one selected from: an europium activated lanthanum sulfide phosphor having a composition represented by a general formula:

$$(La_{1-x-y}Eu_xM_y)_2O_2S$$

where, M is at least one element selected from Sm, Ga, Sb, and Sn, x and y are numbers satisfying $0.08 \le x < 0.16$, $0.000001 \le y < 0.003$;

an europium and bismuth activated yttrium oxide phosphor having a composition represented by a general formula:

$$(Y_{1-x-y}Eu_xBi_y)_2O_3$$

where, x and y are numbers satisfying $0.01 \leq x < 0.15$, $0.001 \leq y < 0.05$;

an europium activated CASN phosphor having a composition represented by a general formula:

$$(Ca_{1-x-y}Sr_xEu_y)SiAlN_3$$

where, x and y are numbers satisfying $0 \leq x < 0.4$, $0 < y < 0.5$; and an europium activated SiAlON phosphor having a composition represented by a general formula:

$$(Sr_{1-x}Eu_x)_\alpha Si_\beta Al_\gamma O_\delta N_\omega$$

where, x, α, β, γ, δ and ω are numbers satisfying $0 < x < 1$, $0 < \alpha \leq 3$, $5 \leq \beta \leq 9$, $1 \leq \gamma \leq 5$, $0.5 \leq \delta \leq 2$, $5 \leq \omega \leq 15$.

11. The LED light bulb according to claim 9, wherein the phosphor screen further includes at least one phosphor selected from a blue-green phosphor and a deep red phosphor.

12. The LED light bulb according to claim 11, wherein the blue-green phosphor includes an europium and manganese activated alkaline earth silicate phosphor having a composition represented by a general formula:

$$(Ba_{1-x-y-z-u}Sr_xMg_yEu_zMn_u)_2SiO_4$$

where, x, y, z, and u are numbers satisfying $0.1 \leq x \leq 0.35$, $0.025 \leq y \leq 0.105$, $0.025 \leq z \leq 0.25$, $0.0005 \leq u \leq 0.02$, and wherein the deep red phosphor includes a manganese activated magnesium fluorogermanate phosphor having a composition represented by a general formula:

$$\alpha MgO.\beta MgF_2.(Ge_{1-x}Mn_x)O_2$$

where, α, β, and x are numbers satisfying $3 \leq \alpha \leq 4$, $0.4 \leq \beta \leq 0.6$, $0.001 \leq x \leq 0.5$.

13. The LED light bulb according to claim 1, wherein the white light has a correlated color temperature of 6500 K or less and an average color rendering index (Ra) of 85 or more.

14. The LED light bulb according to claim 1, wherein the base part has a surface on which the LED module is disposed, and the globe is attached on the surface of the base part.

* * * * *